US006627380B2

(12) United States Patent
Saito et al.

(10) Patent No.: US 6,627,380 B2
(45) Date of Patent: Sep. 30, 2003

(54) PHOTOSENSITIVE COMPOSITION, ORIGINAL PLATE USING THE SAME FOR LITHOGRAPHIC PRINTING, AND METHOD FOR PRODUCING IMAGES ON ORIGINAL PLATE

(75) Inventors: Naohito Saito, Sakura (JP); Yasuyuki Watanabe, Chiba (JP); Yasuhiko Kojima, Konosu (JP); Eiji Hayakawa, Utsunomiya (JP); Koji Oe, Kitamoto (JP)

(73) Assignees: Dainippon Ink and Chemicals, Inc., Tokyo (JP); Kodak Polychrome Graphics LLC, Norwalk, CT (US)

( * ) Notice: Subject to any disclaimer, the term of this patent is extended or adjusted under 35 U.S.C. 154(b) by 249 days.

(21) Appl. No.: 09/860,459

(22) Filed: May 21, 2001

(65) Prior Publication Data

US 2002/0001773 A1 Jan. 3, 2002

(30) Foreign Application Priority Data

May 23, 2000 (JP) ..... P2000-152011

(51) Int. Cl.[7] ..... G03C 1/492

(52) U.S. Cl. ..... 430/270.1; 430/302; 430/944; 430/138

(58) Field of Search ..... 430/270.1, 302, 430/138, 944

(56) References Cited

U.S. PATENT DOCUMENTS

| | | | | | |
|---|---|---|---|---|---|
| 2,714,066 | A | | 7/1955 | Jewett et al. | 95/8 |
| 2,946,638 | A | | 7/1960 | Colo | 312/255 |
| 3,181,461 | A | | 5/1965 | Fromson | 101/149.2 |
| 3,201,247 | A | | 8/1965 | Leonard | 96/75 |
| 3,307,951 | A | | 3/1967 | Adams et al. | 96/86 |
| 3,658,662 | A | | 4/1972 | Casson, Jr. et al. | 204/58 |
| 3,881,924 | A | | 5/1975 | Murakami et al. | 96/1.6 |
| 4,283,475 | A | | 8/1981 | Kawamura et al. | 430/70 |
| 4,645,730 | A | * | 2/1987 | Fromson et al. | 430/155 |
| 4,668,604 | A | * | 5/1987 | Cohen et al. | 430/255 |
| 4,756,993 | A | | 7/1988 | Kitatani et al. | 430/69 |
| 5,156,938 | A | | 10/1992 | Foley et al. | 430/200 |
| 5,275,916 | A | * | 1/1994 | Kato | 430/286.1 |
| 6,218,073 | B1 | * | 4/2001 | Shimizu et al. | 430/273.1 |
| 6,427,595 | B1 | * | 8/2002 | Van Damme et al. | 101/457 |
| 6,503,685 | B1 | * | 1/2003 | Shimizu et al. | 430/270.1 |
| 6,509,133 | B1 | * | 1/2003 | Watanabe et al. | 430/270.1 |
| 2001/0033992 | A1 | * | 10/2001 | Kita | 430/273.1 |
| 2002/0033108 | A1 | * | 3/2002 | Akiyama et al. | 101/457 |

FOREIGN PATENT DOCUMENTS

| | | | |
|---|---|---|---|
| EP | 0773113 | A1 | 5/1997 |
| EP | 0945281 | A2 | 9/1999 |
| EP | 0997272 | A1 | 5/2000 |
| EP | 1038667 | A2 | 9/2000 |
| GB | 434875 | | 9/1935 |
| GB | 1091433 | | 10/1960 |
| GB | 1134093 | | 8/1962 |
| GB | 1108559 | | 4/1968 |
| GB | 1230447 | | 5/1971 |
| JP | 44-6409 | | 3/1969 |
| JP | 57-142645 | | 9/1982 |
| JP | 58-18291 | | 2/1983 |
| JP | 58-112792 | | 7/1983 |
| JP | 58-112793 | | 7/1983 |
| JP | 58-125246 | | 7/1983 |
| JP | 58-173696 | | 10/1983 |
| JP | 58-181051 | | 10/1983 |
| JP | 58-181690 | | 10/1983 |
| JP | 58-194595 | | 11/1983 |
| JP | 58-220143 | | 12/1983 |
| JP | 58-224793 | | 12/1983 |
| JP | 59-048187 | | 3/1984 |
| JP | 59-073996 | | 4/1984 |
| JP | 59-084356 | | 5/1984 |
| JP | 59-101651 | | 6/1984 |
| JP | 59-146061 | | 8/1984 |
| JP | 59-146063 | | 8/1984 |
| JP | 59-202829 | | 11/1984 |
| JP | 59-216146 | | 12/1984 |
| JP | 60-052940 | | 3/1985 |
| JP | 60-063744 | | 4/1985 |
| JP | 60-064352 | | 4/1985 |
| JP | 60-078787 | | 5/1985 |
| JP | 05-013514 | | 1/1993 |
| JP | 05-019702 | | 1/1993 |
| JP | 09-171249 | | 6/1997 |
| JP | 11-268225 | | 10/1999 |
| JP | 11-271962 | | 10/1999 |

OTHER PUBLICATIONS

Color Index Manual "Saishin Ganryou Binran" (New Manual of Pigments) (edited by the Japanese Pigment Technology Association, 1977)–English Summary.

"Saishin Ganryou Ouyou Gijutsu" (New Applied Technology for Pigments) (CMC Publishing, 1986)–English Summary.

"Insatsu Inki Gijutsu" (Printing Ink Technology) (CMC Publishing, 1984)–English Summary.

Carbon Black Manual, 3rd edition, (edited by the Carbon Black Association) 1995, p. 167–English Summary.

(List continued on next page.)

*Primary Examiner*—Janet Baxter
*Assistant Examiner*—Amanda C Walke
(74) *Attorney, Agent, or Firm*—Armstrong, Westerman & Hattori, LLP

(57) ABSTRACT

The present invention relates to a lithographic printing plate in which images can be inscribed by laser beams, and which has high resolving power, high sensitivity, and the improved reservation stability, and relates to its image-producing method, and a photosenstitive composition which can preferably be used as an original plate for lithographic printing. The photosenstitive composition includes an aqueous resin composition including fine particles (a) of a resin having at least one neutralized anionic group and having a heat fusion property, and a water soluble resin (b) having at least one neutralized anionic group, wherein the water soluble resin (b) is included in a range of 1 to 30% by weight, relative to the total weight of the aqueous resin composition; and a substance (c) which absorbs light and generates heat.

10 Claims, No Drawings

OTHER PUBLICATIONS

"Characteristics of Carbon Black and Optimal Formulation and Applied Technology" (Technical Information Association) 1997, p. 111–English Summary.
"Kinzoku Sekken no Seishitsu to Ouyou" (Properties of Metal Soaps and Their Application) (Saiwai Shobo)–English Summary.
"Senryou Binran" (Dye Manual) (edited by the Organic Synthesis Chemistry Association, 1970)–English Summary.
"Shikizai Kougaku Handobukku" (Coloring Material Engineering Handbook) (edited by the Coloring Material Association, Asakura Shoten, 1989)–English Summary.
"Kougyouyou Shikiso no Gijutsu to Shijyou" (Technology and Market of Industrial Coloring Matter) (edited by CMC, 1983)–English Summary.

"Kagaku Binran Ouyou Kagaku Hen" (Chemistry Manual-Applied Chemistry Version) (edited by the Japan Chemistry Society, Maruzen Shoten, 1986)–English Summary.

European Search Report dated Sep. 26, 2001.

* cited by examiner

PHOTOSENSITIVE COMPOSITION, ORIGINAL PLATE USING THE SAME FOR LITHOGRAPHIC PRINTING, AND METHOD FOR PRODUCING IMAGES ON ORIGINAL PLATE

BACKGROUND OF THE INVENTION

1. Field of the Invention

The present invention relates to a lithographic printing plate used in the field of offset printing, and more particularly to an original plate for lithographic printing which can be used in a so-called computer-to-plate (CTP) method and which is applicable to direct plate making based on digital signals from a computer or the like, a method for producing images on the original plate, and a photosenstitive composition preferably used for producing such original plates for lithographic printing.

2. Description of the Related Art

With the progress of the computer image processing technology, there has been recently developed a method for inscribing an image directly on a photosensitive layer by means of photoirradiation based on digital signals. A computer-to-plate (CTP) system, which utilizes this method for lithographic printing to form an image directly on the printing plate without outputting the image to a silver halide mask film, has attracted much attention. The CTP system using high power lasers having maximum strength in a near infrared or infrared region as a light source for photoirradiation has various advantages. For example, compact and high power lasers can be easily obtained, a high resolution image can be produced with a short period of exposure, and the printing plate material used for this method may be handled in a lighted room.

As the printing plate material which is used in the above-described system and which does not require heating before development of latent images, Japanese Unexamined Patent Application, First Publication No. Hei 9-171249 and Japanese Unexamined Patent Application, First Publication No. Hei 11-268225 disclose a manufacturing method for an original plate for lithographic printing using an image forming material including hydrophobic fine resin particles and an alkali soluble resin or a hydrophilic binder.

However, when the weight ratio of hydrophobic fine resin particles included in the image forming material is high relative to the total weight of the hydrophobic fine resin particles and the alkali soluble resin or the hydrophilic binder, the above-described manufacturing method has a problem in that printed material was marred, because the image forming material cannot be completely dissolved in a developer, and thereby, a non-image area cannot be completely removed.

When the weight ratio of the alkali soluble resin or the hydrophilic binder included in the image forming material is high relative to the total weight of the hydrophobic fine resin particles and the alkali soluble resin or the hydrophilic binder, the above-described manufacturing method has a problem in that an image area is removed together with a non-image area during developing, the loss of images occurs, and the development property of the original plate, when stored for long periods under high temperature and high humidity, is decreased.

Moreover, Japanese Unexamined Patent Application, First Publication No. Hei 11-271962 discloses a manufacturing method of an original plate for lithographic printing including a first layer made of an alkali soluble resin and a second layer which is made of fine particles of a heat melting resin and is disposed on the first layer.

However, when a non-image area is removed by using an alkali developer, the manufacturing method has a problem in that the loss of images occurs, because the alkali developer penetrates into the first layer disposed under the second layer including an image area, the alkali soluble resin is dissolved into the alkali developer, and then, the image area is also removed together with the non-image area.

SUMMARY OF THE INVENTION

A first object of the present invention is to provide a useful original plate for lithographic printing, an image-producing method therefor, and a photosenstitive composition preferably used to produce the original plate for lithographic printing, which permits image inscription by laser beam, reduces the image loss, and has a high resolving power, an improved development property which results in reducing blurs in the non-image area, and a high sensitivity, and of which development property is not decreased by storage under the high temperature and high humidity.

A second object of the present invention is to provide a useful original plate for lithographic printing which is used in the computer-to-plate (CTP) system, fulfills the first object mentioned above, and can be applicable to direct plate making based on digital signals from a computer or the like, and in which heat processing is not required prior to developing a latent image.

As a result of extensive research aimed at realizing the above objects, the inventors of the present invention discovered that by using a photosenstitive composition comprising an aqueous resin composition including fine particles of a resin having anionic groups in which some or all of the anionic groups are neutralized, and a water soluble resin having anionic groups in which some or all of the anionic groups are neutralized, an original plate for lithographic printing using the photosenstitive composition can form satisfactory images, which are prevented from generating the loss of images in an image area, and can show satisfactory development properties, and which prevents the generation of blurring in non-image areas. Moreover, by regulating the quantity of the water soluble resin added into the aqueous resin composition, a more useful photosenstitive composition, in which the development property is not reduced even when the photosensitive composition is stored under high temperature and high humidity coditions, can be obtained.

The inventors of the present invention also discovered that by neutralizing some or all of the anionic groups included in the fine particles of the resin with a basic compound, a water soluble resin can be produced, and by controlling the quantity of the basic compound used for the neutralization, the amount of water soluble resin produced can be easily regulated, so that a photosenstitive composition having satisfactory storage stability can be obtained.

The inventors of the present invention also discovered that by forming a photosensitive layer using the photosenstitive composition onto a hydrophilic surface of a support, a useful original plate for lithographic printing can be obtained. As a result, the present invention has been completed.

That is, the present invention provides a photosenstitive composition comprising an aqueous resin composition including fine particles (a) of a resin having at least one neutralized anionic group and having a heat fusion property, and a water soluble resin (b) having at least one neutralized anionic group, wherein the water soluble resin (b) is included in a range of 1 to 30% by weight, relative to the total weight of the aqueous resin composition; and a substance (c) which absorbs light and generates thermal energy.

The aqueous resin composition may be produced by adding a basic compound to fine particles (a') of a resin having at least one anionic group and having a heat fusion property. The fine particles (a') of the resin having at least one anionic group and having a heat fusion property may be produced by an emulsion polymerization.

The glass-transition temperature of the resin showing a heat fusion property may be in a range of 50 to 150° C. The resin forming the fine particles (a) or the fine particles (a') may have 35 to 530 millimoles of anionic groups per 100 g of resin solid content. The fine particles (a) may be crosslinked with each other.

The present invention also provides an original plate for lithographic printing comprising a support having a hydrophilic surface; and a photosensitive layer which includes the photosenstitive composition according to the present invention and is disposed on the hydrophilic surface.

The present invention also provides an image-producing method comprising the steps of inscribing images by using a laser beam on the original plate for lithographic printing according to the present invention, and developing the images by using a basic aqueous solution or water. The laser beam may have maximum strength in a range of 760 to 3,000 nm.

DETAILED DESCRIPTION OF THE INVENTION

In the following, an embodiment according to the present invention will be specifically explained.

Since a photosensitive composition includes an aqueous resin composition including fine particles (a) of a resin having at least one neutralized anionic group and having a heat fusion property (hereinafter referred to as "fine particles (a)") and a water soluble resin (b) having at least one anionic group (hereinafter referred to as "fine particles (b)"), the photosensitive composition can be dissolved into an alkaline aqueous solution (a developer). Therefore, a non-image area of a photosensitive layer using the photosenstitive composition can be completely removed by the developer. Moreover, since some or all of the fine particles (a) and the aqueous resin (b) are neutralized, the photosensitive composition can be stably dispersed and dissolved in water. Therefore, the photosensitive composition is stabilized for a long time, and will not precipitate.

The photosensitive composition further includes a substance (c) which absorbs light and generates heat. The substance (c) can convert light energy of irradiated-light into thermal energy. When the photosensitive composition is irradiated by light, the fine particles (a) are melted, fused, and denaturated by the thermal energy generated by the substance (c), and then, the fine particles (a) are denaturated so that they barely dissolve in a developer. Thus, the light energy caused by image-producing irradiation forms latent images on an original plate for lithographic printing including the photosensitive layer using the photosensitive composition. Then, images can be formed by developing the latent images with a developer.

The mean particle diameter of the fine particles (a) of the resin having at least one neutralized anionic group and having a heat fusion property may be preferably 0.01 to 15 μm, more preferably 0.05 to 15 μm, so as to effectively cause heat denaturation. When the mean particle diameter is over 15 μm, there is a tendency for the fine particles affected by the generated thermal energy to not be completely melted and fused. When the mean particle diameter is under 0.01 μm, there is a tendency for the fine particles to become the water soluble resin (b). For example, when the fine particles have a mean particle diameter of 0.02 μm and have a relatively broad distribution of particle diameters, the fine particles become relatively unsuitable for use as fine particles (a), because the content of the water soluble resin (b) is increased. However, even when the mean particle diameter of the fine particles is small, provided that the distribution of the particle diameter is extremely narrow, the content of the water soluble resin (b) is no more than 30% by weight, relative to the total weight of the aqueous resin composition, and that the fine particles (a) and the water soluble resin (b) have respectively at least one neutralized anionic group, the fine particles can be used as the aqueous resin composition.

Specific examples of the anionic group of the fine particles (a) include a carboxyl group, a sulfo group, a phosphate group, and a sulphonyl group. Among these groups, a carboxyl group may be preferably used because it can easily be substituted. The content of the anionic group substituted in the fine particles (a) may be preferably in a range of 35 millimoles to 530 millimoles per 100 g of resin solid content. When the content of the anionic group is under 35 millimoles per 100 g of resin solid content, there are tendencies for the fine particles (a) to be barely dissolved in a developer, and for the non-image area to become difficult to remove. In contrast, when the content of the anionic group is over 530 millimoles per 100 g of resin solid content, synthesis of the fine particles (a) tends to become substantially difficult. The content of the anionic groups substituted in the fine particles (a) affects the removal of non-image areas by using an alkali solution after formation of latent images and affects the storage stability. Hence, sufficient care should be taken in selecting the content while considering the component ratio of the fine particles (b) described below.

The fine particles (a) are mutually melted and fused due to the thermal energy converted from the light energy absorbed by the substance (c). Therefore, the glass-transition temperature (Tg) of the fine particles (a) may preferably be low, so that the fine particles (a) are melted and fused by less thermal energy. Specifically, the Tg of the fine particles (a) may preferably be in a range of 20 to 150° C. When the Tg of the fine particles (a) is below 20° C., the fine particles (a) tend to be melted and fused with each other during storage at room temperature, which results in degradation of the development property. When the Tg of the fine particles (a) is over 150° C., since the fine particles (a) are required to be irradiated by high light energy so as to be melted and fused with each other, the fine particles (a) become substantially unsuitable for use.

When the Tg of the fine particles (a) is below 50° C., it is difficult to dry a phtosensitive layer disposed on a support by heating, and the development property of the fine particles (a) stored for a long time is decreased because of mutual melting and fusion of the fine particles (a). Hence, the Tg of the fine particles (a) may be preferably in a range of 50 to 150° C.

As specific examples of a method for preparing fine particles (a), there can be mentioned a pulverization method which yields fine particles by pulverizing high polymers, an emulsification method which emulsifies a resin using an emulsifier, a reverse phase emulsification method, a emulsion polymerization method, or like methods. Provided that the target fine particles (a) can be obtained, there is no limitation imposed on methods of preparation therefor.

An emulsifier used in the emulsion polymerization method affects the sensitivity and the ink acceptability of the original plate for lithographic printing. Hence, sufficient care should be taken in selecting the kind and the quantity of the emulsifier used. However, the emulsion polymerization method may be preferably used for producing the fine particles (a) and the fine particles (a') of the resin having at least one anionic group and having a heat fusion property, for the following reason.

(1) The anionic group or another functional group can be easily substituted into the fine particles by using polymerizable monomers having at least one anionic group or another functional group.

(2) The Tg can be easily regulated.

(3) The content of the water soluble resin (b) in the aqueous resin can be easily regulated by the method described below.

The fine particles (a) of the resin having at least one neutralized anionic group and having a heat fusion property may be easily produced by neutralizing the fine particles (a') of the resin having at least one anionic group and having a heat fusion property with a basic compound.

In the following, a production method for the fine particles (a) and the fine particles (a') will be explained.

The fine particles (a') may be produced by emulsifying and polymerizing polymerizable monomers having at least one anionic group, if desired, with other polymerizable monomers.

Specific examples of monomer having at least one anionic group include monoalkyl maleates such as (meth)acrylate, crotonic acid, fumaric acid, itaconic acid, maleic acid, sorbic acid, monobutyl maleate; a polymerizable monomer having a carboxyl group such as monoalkyl itaconate; a polymerizable monomer having a sulfo group such as methallyl sulfonate; a polymerizable monomer having a phosphate group; and a polymerizable monomer having a sulfuric ester group. Among these, the polymerizable monomer having a carboxyl group may be preferably used, and acrylic acid and methacrylic acid may be specifically used, since copolymerization with other polymerizable monomers can be easily carried out.

Specific examples of other polymerizable monomers include a styrene, a hydroxystyrene, an acrylonitrile, an acrylamide, acrylamide derivatives such as N-octyl acrylamide and methylene bisacrylamide, (meth)acrylate esters such as methyl (meth)acrylate, ethyl (meth)acrylate, butyl (meth)acrylate, 2-hydroxy ethyl(meth)acrylate, and 2-hydroxy propyl (meth)acrylate, amino ethyl (meth) acrylates such as dimethyl amino ethyl (meth)acrylate, and diethyl amino ethyl (meth)acrylate, vinyl acetate, and the like. Among these, one can be used alone; alternatively, two or more can be used together.

As other polymerizable monomers, a reactive monomer having two or more functional groups can be used to obtain fine particles crosslinked with each other. The fine particles crosslinked with each other can be used to improve the printing resistance or the storage stability, and to regulate the sensitivity. Specific examples of the monomer include a divinyl compound, a di(meth)acrylate compound, a tri (meth)acrylate compound, a tetra(meth)acrylate compound, a diallyl compound, a triallyl compound, and a tetraallyl compound, and more specifically include divinyl benzene, divinyl adipate, ethyleneglycol di(meth)acrylate, diethyleneglycol di(meth)acrylate, triethyleneglycol di(meth) acrylate, polyethyleneglycol di(meth)acrylate, polypropyleneglycol di(meth)acrylate, neopentylglycol di(meth) acrylate, 1,3-butyleneglycol di(meth)acrylate, 1,3-butyl di(meth)acrylate, trimethylolethane tri(meth)acrylate, trimethylolpropane tri(meth)acrylate, dipentaerythrite tri(meth) acrylate, diallylphthalate, triallyl dicyanulate, tetraallyloxy ethane, and allyl (meth)acrylate. Among these, one can be used alone; alternatively, two or more can be used together.

As the polymerization initiator used for the emulsion polymerization, commonly known ones may be used, specific examples of which include various persulfates such as an ammonium persulfate, and a potassium persulfate, various redox type initiators such as a hydrogen peroxide-metallic salt, an organoperoxide-metallic salt, an organoperoxide-aliphatic or alicyclic polyamine compound, an organoperoxide-dimethyl aniline, and a potassium dichromate-metallic oxide, and various azo compounds such as an aromatic diazoamino compound, an aromatic diazothioether compound, an aromatic diazoxy compound, and an analiphatic diazo compound.

As the emulsifier used for the emulsion polymerization, commonly known ones may be used; specific examples of the emulsifier include various anionic surfactants such as fatty acid salts such as potassium laurate, potassium myristate, and potassium stearate, sulfates such as sodium cetylsulfate, alkyl sulfates such as sodium dodecylsulfate, and sodium lauryl sulfate, an alkylallyl sulfate such as sodium dodecyltoluenesulfate, and a dialkyl sulfosuccinate such as sodium dioctyl sulfosuccinate; various nonionic surfactants such as alkoxypoly(ethylene oxide)ethanol compounds, alkylphenoxypoly(ethylene oxide)ethanol compounds, alkoxy (ethylene oxide) ethanol ester compounds, alkoxy cellulose compounds; and various cationic surfactants such as alkyl ammonium salts such as dodecyl ammonium acetate, tertiaryamine salts such as hexadecyltrimethyl ammonium acetate, an alkylpyridinium salt, and the like.

The fine particles (a') can be synthesized by using the conventional emulsion polymerization method. For example, the suitable polymerizable monomer and the suitable emulsifier are added to a water and emusified, followed by adding an initiator and carrying out polymerization in an inert gas atmosphere, and if desired, with heating. Alternatively, a mixture of a suitable polymerizable monomer and a suitable surfactant and an initiator are dipped into water to carry out polymerization in an inert gas atmosphere, and if desired, with heating.

Specific examples of the basic compound used for neutralizing the fine particles (a') include amine compounds such as monomethylamine, dimethylamine, trimethylamine, monoethylamine, diethylamine, triethylamine, monoisopropylamine, diisopropylamine, n-butylamine, di-n-butylamine, monoethanolamine, diethanolamine, triethanolimine, ethylenimine, and ethylendiamine; inorganic alkali compounds such as potassium hydroxide, sodium hydroxide, lithium hydroxide, and ammonia.

When the fine particles (a') are neutralized, a water soluble resin (b) is produced together with the fine particles (a) of the resin having at least one anionic group and having a heat fusion property. At this time, the amount of the produced water soluble resin (b) varies in accordance with the kind or the quantity of the basic compound used.

The water soluble resin (b) having at least one neutralized anionic group refers to a water soluble resin, in which some or all of the anionic groups are neutralized, and of which aqueous solution is transparent, and in which the resin is not precipitated under the condition in which the gravitational acceleration is high.

A "water soluble resin" generally refers to a resin which can be uniformly dissolved in water, that is, which forms a transparent solution by dissolving in a water. The fine particles also become translucent or transparent from a dark milky color as the particle diameter of the fine particles decreases. Hence, it is difficult to distinguish fine particles from the water soluble resin.

In contrast, the fine particles can be precipitated at a final speed determined by the particle diameter and the specific gravity thereof, the viscosity and the specific gravity of solvent used, and the gravitational acceleration. Therefore, the water soluble resin (b) refers to a component which is not precipitated under the condition in which the gravitational acceleration is high, more specifically a component which is not precipitated by centrifugation for 2 hours at 3,330,000 $m/s^2$ at a gravitational acceleration of 340,000 G.

The water soluble resin (b) may be produced by neutralizing the resin having 53 to 1400 millimoles of anionic groups per 100 g of resin solid content with the basic compound, to neutralize some or all of the anionic groups and thereby produce the water soluble resin. Specific examples of the anionic group include a carboxyl group, a sulfonic group, a phosphate group, and a sulphonyl group. Among these, the carboxyl group may be preferably used because it can be easily substituted.

As described above, the Tg of the water soluble resin (b) may be preferably in a range of 20 to 150° C., more preferably 50 to 150° C., in order to improve the storage stability.

The water soluble resin (b) can fill up spaces between the fine particles (a), can reinforce film strength, and can improve the damage resistance. The substance (c) which absorbs light and generates heat is dispersed into the aqueous resin composition including the fine particles (a) and the water soluble resin (b), so as to efficiently produce the heat.

In contrast, the inventors of the present invention discovered that the storage stability of a produced original plate for lithographic printing is decreased when the content of the water soluble resin (b) in the aqueous resin composition is high. That is, a non-image area of the photosensititive layer stored under high temperature and high humidity becomes difficult to dissolve in a developer, with the increase of the content of the water soluble resin (b) in the aqueous resin composition including the fine particles (a) and the water soluble resin (b).

The content of the water soluble resin (b) is evaluated by measuring respectively a dry solids ratio of an aqueous solution of the aqueous resin composition and a dry solids ratio of the supernatant obtained by centrifuging the aqueous solution of the aqueous resin composition for 2 hours at 3,330,000 $m/s^2$ at a gravitational acceleration of 340,000 G, and by calculating the content of the water soluble resin (b) in accordance with the following formula:

[the content of the water soluble resin (% by weight)=dry solids ratio of the supernatant/dry solids ratio of the aqueous solution of the aqueous resin composition× 100]

The content of the water soluble resin (b) in the aqueous resin composition may be preferably in a range 1 to 30% by weight, more preferably 1 to 20% by weight, relative to the total weight of the aqueous resin composition. When the content of the water soluble resin (b) is under 1% by weight, there is a tendency for the film strength of the photosensitive layer to decrease and the surface of a resulting printing plate using the photosensitive layer is easily damaged. When the content of the water soluble resin (b) is over 30% by weight, there is a tendency for the development property to be decreased by storing at high temperature and high humidity.

The aqueous resin composition can be produced by adding the aqueous resin (b) having at least one neutralized anionic group into the fine particles (a) of the resin having at least one neutralized anionic group and having a heat fusion property.

The aqueous resin composition can be produced by adding the basic compound into the fine particles (a') having at least one neutralized anionic group and having a heat fusion property, to produce the fine particles (a) of the resin having at least one neutralized anionic group and having a heat fusion property and the aqueous resin (b) having at least one neutralized anionic group at the same time. That is, the water soluble resin (b) can be produced from fine particles of the resin by adding the basic compound into the fine particles (a'), so that the fine particles (a) and the water soluble resin (b) can be produced at the same time. This process may be carried out by using the fine particles crosslinked with each other. According to these methods, the aqueous resin composition can be easily produced, and the content of the aqueous resin (b) in the aqueous resin composition can be easily regulated by selecting the kind or the quantity of the basic compound used. Hence, these methods can be preferably used.

The substance (c) which absorbs light and generates heat indicates a substance which absorbs light irradiated in the photosensitive composition layer and generates thermal energy, and as such a substance, there can be mentioned, for example, various pigments or dyes.

As the pigment which can be used in the present invention, there can be used commercially available pigments and those pigments described in the Color Index Manual "Saishin Ganryou Binran" (New Manual of Pigments) (edited by the Japan Pigment Technology Association, 1977), "Saishin Ganryou Ouyou Gijutsu" (New Applied Technology for Pigment) (CMC Publishing, 1986), "Insatsu Inki Gijutsu" (Printing Ink Technology) (CMC Publishing, 1984), etc. The types of pigment include black pigments, yellow pigments, orange pigments, brown pigments, red pigments, violet pigments, blue pigments, green pigments, fluorescent pigments, and in addition, polymer bound coloring pigments. More specifically, there can be used insoluble azo pigments, azo lake pigments, condensed azo pigments, chelate azo pigments, phthalocyanine base pigments, anthraquinone base pigments, perylene and perinone base pigments, thioindigo base pigments, quinacridone base pigments, dioxazine base pigments, isoindolinone base pigments, quinophthalone base pigments, dye lake pigments, azine pigments, nitroso pigments, nitro pigments, natural pigments, fluorescent pigments, inorganic pigments, carbon black, etc.

Among these specific examples, carbon black is particularly preferred as a substance which absorbs a near infrared to infrared ray laser beam to efficiently generate heat, and is economically competitive. At present, carbon blacks having various functional groups and having excellent dispersibility are commercially available and, for example, carbon blacks described in detail in "Carbon Black Manual, 3rd edition, (edited by the Carbon Black Association) 1995, p. 167", "Characteristics of Carbon Black and Optimal Formulation and Applied Technology (Technical Information Association) 1997, p. 111", etc., can be preferably used in the present invention.

These pigments may be used without surface treatment or may be subjected to a known surface treatment. As a known surface treating method, there can be used a method including surface-coating a resin or wax, a method which attaches a surfactant, a method in which a reactive substance, such as a silane coupling agent or an epoxy compound, polyisocyanate, is bound to the surface of a pigment, and so on. These surface treating methods are described in "Kinzoku Sekken no Seishitsu to Ouyou" (Properties of Metal Soaps and Their Application) (Saiwai Shobo), "Saishin Ganryou Ouyou Gijutsu" (New Applied Technology for Pigment) (CMC Publishing, 1986), and "Insatsu Inki Gijutsu" (Printing Ink Technology) (CMC Publishing, 1984).

The pigment used in the present invention preferably has a particle diameter within the range of 0.01 to 15 $\mu$m, and more preferably 0.01 to 5 $\mu$m.

As the dye which can be used in the present invention, there can be used any known conventional dye and there can be mentioned, for example, those described in "Senryou Binran" (Dye Manual) (edited by the Organic Synthesis Chemistry Association, 1970), "Shikizai Kougaku Handobukku" (Coloring Material Engineering Handbook) (edited by the Coloring Material Association, Asakura Shoten, 1989), "Kougyouyou Shikiso no Gijutsu to Shijyou" (Technology and Market of Industrial Coloring Matter) (edited by CMC, 1983), and "Kagaku Binran Ouyou Kagaku Hen" (Chemistry Manual—Applied Chemistry Version) (edited by the Japan Chemistry Society, Maruzen Shoten, 1986). More specifically, there can be mentioned azo dyes, metal complex azo dyes, pyrazolone azo dyes, anthraquinone dyes, phthalocyanine dyes, carbonium dyes, quinoneimine dyes, methine dyes, cyanine dyes, indigo dyes, quinoline dyes, nitro dyes, xanthene dyes, thiazine dyes, azine dyes, and oxazine dyes. Among these specific examples, ones which absorb light of from the near infrared to the infrared region are particularly preferred.

The dyes which absorb near infrared light to infrared light include, for example, cyanine dyes described in Japanese Patent Unexamined Publications Nos. 58-125246, 59-84356, 59-202829, 60-78787, etc.; methane dyes described in Japanese Patent Unexamined Publications Nos. 58-173696, 58-181690, and 58-194595, etc.; naphthoquinone dyes described in Japanese Patent Unexamined Publications Nos. 58-112793, 58-224793, 59-48187, 59-73996, 60-52940, 60-63744, etc.; squarylium dyes described in Japanese Patent Unexamined Publications No. 58-112792; cyanine dyes described in United Kingdom Patent No. 434,875; infrared absorption agents described in U.S. Pat. No 5,156,938 and the like. Furthermore, there can be mentioned: substituted arylbenzo (thio)pyridinium salt described in U.S. Pat. No. 3,881,924; trimethinethiapyrylium salt described in Japanese Patent Unexamined Publications No. 57-142645; pyrylium compounds described in Japanese Patent Unexamined Publications Nos. 58-181051, 58-220143, 59-146063, and 59-146061; cyanine dyes described in Japanese Patent Unexamined Publications No. 59-216146; penamethinethio pyrylium salt described in U.S. Pat. No. 4,283,475; pyrylium compounds described in Japanese Patent Unexamined Publications Nos. 5-13514 and 5-19702; and infrared absorption dyes described in U.S. Pat. No. 4,756,993.

As the substance (c) which absorbs light and generates heat, at least one kind of suitable pigment or dye, which can absorb a specific wavelength from a light source described below and convert this to thermal energy, may be selected among the above described pigments or dyes. The substance (c) is added to the aqueous resin composition layer to produce the photosensitive composition.

When a pigment is used as the substance (c), the amount of pigment to be used is preferably in a range of from 1 to 70% by weight, and more preferably in a range of from 3 to 50% by weight, with respect to the total solid content in the photosensitive composition. When the added amount is less than 1% by weight, even if the pigment absorbs light and generates thermal heat, the amount of the thermal energy tends not to be sufficient to fuse the co-existing fine particles. In contrast, when the added amount is larger than 70% by weight, the amount of the thermal energy generated tends to be sufficient to cause burning, rupture, or the like, and there is a tendency for it to be difficult to form a fused latent image suitable for forming an image, which is not desirable.

When a dye is used as the substance (c), the amount of dye to be used is preferably in a range of from 0.1 to 30% by weight, and more preferably in a range of from 0.5 to 20% by weight, with respect to the total solid content in the photosensitive composition layer. When the added amount is less than 0.1% by weight, even if the pigment absorbs light and generates thermal heat, the amount of the thermal energy tends not to be sufficient to fuse the co-existing fine particles. In contrast, when the added amount is larger than 30% by weight, the amount of the thermal energy generated tends to reach a saturation level, and there is a tendency for the addition to exert no effect, which is not desirable.

Below is a description of a case where a photosenstitive composition according to the present invention is applied to an original plate for lithographic printing.

The original plate for lithographic printing is produced by providing a photosensitive layer using the photosensitive composition on a support having a hydrophilic surface. Although the photosensitive layer may be called a heat-sensitive layer because it uses thermal energy converted from light energy generated by light-irradiation, it is called a photosenstive layer in this specification, for convenience.

As the support, there can be cited, for example, plates of metal such as aluminum, zinc, copper, stainless steel, iron, etc.; films of plastics such as polyethyleneglycol terephthalate (PET), polycarbonate, polyvinyl acetal, polyethylene, etc.; a composite material such as paper or plastic film which has been coated with a synthetic resin solution and which is provided with a metal layer by vacuum deposition, lamination or similar technology; and the like. Of these, particularly preferred are an aluminum support and a composite support covered with aluminum.

The surface of the aluminum support is desirably surface-treated for the purpose of increasing water retention and improving the adhesion with the photosensitive layer. For example, surface roughening methods include a brush polishing method, a ball polishing method, electrolytic etching, chemical etching, liquid honing, sand blasting, and combinations of these. A surface roughening method including the use of electrolytic etching is particularly preferred.

The electrolytic bath used during electrolytic etching includes aqueous solutions containing an acid, an alkali or their salts, and an aqueous solution containing an organic solvent. Of these, particularly preferred are electrolytes containing hydrochloric acid, nitric acid, or their salts.

Further, aluminum plates subjected to surface roughening treatment, if desired, may be subjected to desmutting treatment with an aqueous solution of acid or alkali. The aluminum plate thus obtained is desirably anodized. Particularly, a method is desirable which uses for the treatment a bath containing sulfuric acid or phosphoric acid.

Further, if desired, various treatments can be carried out, for example, a silicate treatment (sodium silicate, potassium silicate) as described in U.S. Pat. No. 2,714,066, U.S. Pat. No. 3,181,461, a potassium zirconium fluoride treatment as described in U.S. Pat. No. 2,946,638, a phosphomolybdate treatment as described in U.S. Pat. No. 3,201,247, alkyl titanate treatment as described in United Kingdom Patent No. 1,108,559, a polyacrylic acid treatment as described in German Patent No. 1,091,433, a polyvinylphosphonic acid treatment as described in German Patent No. 1,134,093 and United Kingdom Patent No. 1,230,447, a phosphonic acid treatment as described in Japanese Examined Patent Application, Second Publication No. Sho 44-6409, a phytic acid treatment as described in U.S. Pat. No. 3,307,951, a treatment with a salt of a hydrophilic organic high molecular compound and a divalent metal as described in Japanese Unexamined Patent Application, First Publication No. Sho 58-18291, a hydrophilic treatment by undercoating a water-soluble polymer having a sulfonic acid group as described in Japanese Unexamined Patent Application, First Publication No. Sho 59-101651, a coloring treatment with an acid dye as described in Japanese Unexamined Patent Application, First Publication No. Sho 60-64352, a silicate electrodeposition treatment as described in U.S. Pat. No. 3,658,662, etc.

It is also preferred that the aluminum plates be subjected to sealing treatment for sealing pore cavities after sand blasting and anodizing. The sealing treatment can be carried out by dipping in a hot aqueous solution containing hot water and inorganic salt or organic salt or in a steam bath, etc.

The original plate for lithographic printing can be produced by applying the coating solution containing the above-described photosenstitive composition on the support and drying by conventional techniques.

The coating solution containing the photosenstitive composition can be prepared by dispersing or dissolving the pigment or the dye into a solution including the aqueous resin composition. The coating solution containing the photosenstitive composition can also be prepared by mixing the aqueous resin composition with the pigment or the dye which are dispersed or dissolved into water or a mixed solvent including water and an organic solvent.

As dispersing machines which are used to disperse the pigment or the dye, there can be used conventional dispersing machines, such as an ultrasonic disperser, a sand mill, an attritor, a barrel mill, a super mill, a ball mil, an impeller, a disperser, a KD mill, a colloid mill, a dynatron, a three-roll mill, a pressure kneader, paint conditioner, etc. At this time, the organic solvent may be used. The organic solvent may preferably be an organic solvent having a low melting point which can dissolve in water uniformly, specific examples of which include alchols such as methanol, ethanol, n-propanol, isopropanol, n-butanol, sec-butanol, and t-butanol, ketones such as acetone, methyl ethyl ketone, and methyl isobutyl ketone, esters such as ethyl acetate and butyl acetate, and aromatic hydrocarbons such as toluene and xylene.

The coating solution including the photosenstitive composition layer may further contain various coating aids for improving coatability. For example, in order to adjust the viscosity, there can be added various natural water-soluble polymers, synthetic water-soluble polymers, water-soluble organic solvents such as methanol, ethanol, isopropanol, acetone, methyl ethyl ketone, ethyl acetate, ethylene glycol, or propylene glycol, various surfactants, or the like.

The coating solution including the photosenstitive composition layer thus prepared is applied on the support by conventional techniques, after adjusting the solids content of the coating solution to preferably 1 to 50% by weight, relative to the total weight of the coating solution. As a coating method, there can be cited a rotary coating method using a spin coater or the like, a dip coating method, a roll coating method, a curtain coating method, a blade coating method, an air knife coating method, a spray coating method, a bar coater coating method, or the like.

The coating solution including the photosenstitive composition layer coated on the support is preferably dried at 30 to 150° C. for 10 seconds to 10 minutes using a hot air dryer, an infrared dryer, etc.

Next, a method for preparing a printing plate using the original plate for lithographic printing (an image-producing method) will be explained.

The original plate for lithographic printing is a so-called computer-to-plate (CTP) plate, which allows direct image inscription onto the plate using a laser beam based on digital image information from a computer or the like.

The light source used includes various semiconductor lasers having lasing wavelengths of 300 to 950 nm, a carbon dioxide gas laser (lasing wavelength: 10.6 nm), a YAG laser (lasing wavelength: 532 nm, 1064 nm), an excimer laser (lasing wavelength: 193 nm, 308 nm, 351 nm), an argon laser (lasing wavelength: 488 nm), and the like. In each case, such an light source can be used by selecting a pigment or a dye which can absorb light of a specified wavelength from the light source and convert it to heat from among the above-described pigments or dyes and adding the selected pigment or dye to the photosensitive composition.

Since the original plate for lithographic printing can be handled in a lighted room, a high power laser having maximum strength in a near infrared to infrared region is preferably used. As the high power laser having the maximum strength in a near infrared to infrared region, there can be mentioned various lasers having the maximum strength in the near infrared to infrared region of from 760 nm to 3000 nm, for example, a semiconductor laser, YAG laser, etc.

The original plate for lithographic printing is used to prepare a printing plate, in which the photosensitive composition layer is stripped of its non-image portion by a wet method in the development after images are inscribed with a laser beam. The developer used in the development is water or an alkaline aqueous solution (a basic aqueous solution).

An alkali agent included in the developer is, for example, an inorganic alkali agent such as sodium silicate, potassium silicate, sodium hydroxide, potassium hydroxide, lithium hydroxide, sodium tertiary phosphate, sodium secondary phosphate, potassium tertiary phosphate, potassium secondary phosphate, ammonium tertiary phosphate, ammonium secondary phosphate, sodium metasilicate, sodium hydrogen carbonate, ammoniacal water, and an organic alkali agent such as tetraalkylammonium hydride mono methylamine, dimethylamine, trimethylamine, monoethylamine, diethylamine, triethylamine, monoisopropylamine, diisopropylamine, n-butylamine, di-n-butylamine, monoethanolamine, diethanolamine, tridiethanolamine, ethyleneimine, and ethylendiamine.

The content of the alkali agent in the developer is preferably 0.005 to 10% by weight, and more preferably 0.05 to 5% by weight, relative to the total weight of the developer. If the content is less than 0.05% by weight, development tends to fail, while a content above 10% by weight tends to adversely affect the image area, such as by corrosion upon the development.

The developer may contain an organic solvent, specific examples of which include ethyl acetate, butyl acetate, amyl acetate, benzyl acetate, ethylene glycol monobutyl acetate, butyl lactate, butyl levurate, methyl ethyl ketone, ethyl butyl ketone, methyl isobutyl ketone, cyclohexanone, ethylene glycol monobutyl ether, ethylene glycol benzyl ether, ethylene glycol monophenyl ether, benzyl alcohol, methyl phenyl carbinol, n-amyl alcohol, methylamyl alcohol, xylene, methylene dichloride, ethylene dichloride, monochlorobenzene, and the like. When the organic solvent is added to the developer, the content of the organic solvent may be preferably 20% by weight or less, more preferably 10% by weight or less, relative to the total weight of the developer.

Further, the developer may, if desired, contain water-soluble sulfites such as lithium sulfite, sodium sulfite, potassium sulfite and magnesium sulfite, alkali-soluble pyrazolone compounds, alkali-soluble thiol compounds, hydroxyaromatic compounds such as methylresorcinol, water softeners such as polyphosphoric acid salts and aminopolycarboxylic acids, anionic, nonionic, cationic, amphoteric, or fluorine surfactants such as sodium isopropylnaphthalenesulfonate, sodium n-butylnaphthalenesulfonate, sodium N-methyl-N-pentadecylaminoacetate, and sodium laurylsulfate, defoaming agent, or the like.

Although the developer used in the image-producing method may be the above-described composition, commercially available developers used in the development processing of a negative-type PS plate or positive-type PS plate may be practically used. In particular, the commercially available concentrated type developers for negatives or positives after diluting them 1 to 1,000 fold, can be used as the developer for the development of the original plate for lithographic printing.

The processing of the development of the original plate for lithographic printing is carried out preferably at a temperature of 15 to 40° C. for 1 second to 2 minutes, by dipping the plate for the original plate. If desired, the surface of the original plate may be rubbed lightly.

The original plate after development is subjected to washing with water and/or treatment with an aqueous oil desensitizer. As the aqueous oil desensitizer, there can be cited water-soluble natural polymers such as gum Arabic, dextrin, and carboxymethylcellulose; water-soluble synthetic polymers such as polyvinyl alcohol, polyvinylpyrrolidone, and polyacrylic acid. If desired, acids, surfactants, or the like may be added to the aqueous oil desensitizers. Thereafter, the desensitizers are dried and used for printing as a printing plate.

Although the series steps for producing images may be practiced individually, in practice, it is easy and preferable to use an automatic processing machine which can perform these steps throughout. At this time, the original plate for lithographic printing does not require a special safelight and can be used with exposure to an ordinary quantity of a room light before and after exposure. Although an original plate for lithographic printing used conventionally is necessary to be heated after image-inscription and before development to form latent images, the original plate for lithographic printing according to the present invention does not require heating after image-inscribing.

The photosenstitive composition of this present invention can be used for various uses other than the original plate for lithographic printing.

EXAMPLES

In the following, the present invention will be explained more specifically by showing examples. However, the present invention is not limited to the following examples.

In the following examples, the dry solids ratio was expressed by measuring a weight ratio of a sample of 1 g before and after the sample was dried at 130° C. for 1 hour.

The number average molecular weight was measured by gel permeation chromatography (hereinafter referred to as "GPC"), and expressed in molecular weight terms of polystyrene.

The quantity of the water soluble resin is measured by centrifugation of the sample for 2 hours at 100,000 revolutions per minute (3,330,000 m/s$^2$, 340,000 G) by means of a centrifuge (trade name of "Optima TLX" manufactured by Beckman Coulter, Inc.) to precipitate fine particles of a resin, and then, by measuring the dry solids ratio of the supernatant thereof.

The glass-transition temperature (Tg) was measured by using a differential scanning calorimeter (DSC).

The storage stability was evaluated by change of the development property measured by dipping the sample into a 1:99 diluted solution of a developer for positive PS plates "PD-1" (manufactured by Kodak Polychrome Graphics Japan Ltd.) at 30° C. for 30 seconds to effect development before and after heating the sample in a thermo-hygrostat at 60° C. and 75% humidity for 15 hours.

Synthesis Example 1

Synthesis Example of Aqueous Resin Composition (A)

In a 1 liter four-necked flask equipped with a stirrer, a condenser, a dry nitrogen introduction pipe with a thermometer, and a dripping apparatus were charged 228 g of distilled water, 0.22 g of methyl methacrylate, and 0.44 g of "NEWCOL-560SF"(trade name for emulsifier manufactured by Nippon Nyukazai Co., Ltd.) and heated to 80° C. with stirring well. After 15 minutes of stirring, 0.22 g of methyl methacrylate and 0.22 g of butyl methacrylate were added into the four-necked flask and were mixed well with each other. After 20 minutes of stirring, a solution, in which 0.17 g of ammonium persulfate was dissolved into 5 g of distilled water, was added into the four-necked flask, and then stirred well. After 20 minutes of stirring, a mixture including 34 g of styrene, 83.73 g of methyl methacrylate, 37.0 g of butyl methacrylate, 15.26 g of acrylic acid, and 1.26 g of "NEWCOL-560SF", and a solution, in which 0.29 g of ammonium persulfate were dissolved into 50 g of distilled water, were respectively dripped over 3 hours by means of different dripping apparatuses. After dripping, stirring was further continued for 5 hours to obtain an emulsion of acrylic fine resin particles having a dry solids ratio of 38.5% by weight, a volume mean particle diameter of 0.089 $\mu$m, 124.7 millimoles of carboxyl groups per 100 g of resin solid content, and a water soluble resin content of 0.3% by weight, relative to the total weight of acrylic fine resin particles. Hereinafter, this emulsion is referred as an aqueous resin composition (A).

Synthesis Example 2

Synthesis Example of Aqueous Resin Composition (B)

In a 1 liter four-necked flask equipped with a stirrer, a condenser, a dry nitrogen introduction pipe with a thermometer, and a dripping apparatus were charged 228 g of distilled water, 0.22 g of methyl methacrylate, and 0.44 g of "NEWCOL-560SF"(trade name for emulsifier manufactured by Nippon Nyukazai Co., Ltd.) and were heated to 80°

C. while stirring well. After 15 minutes of stirring, 0.22 g of methyl methacrylate and 0.22 g of butyl methacrylate were added into the four-necked flask and were mixed well with each other. After 20 minutes of stirring, a solution in which 0.17 g of ammonium persulfate was dissolved into 5 g of distilled water was added into the four-necked flask, and then stirred well. After 20 minutes of stirring, a mixture including 34 g of styrene, 81.73 g of methyl methacrylate, 35.59 g of butyl methacrylate, 15.26 g of acrylic acid, 3.4 g of divinyl benzene, and 1.26 g of "NEWCOI560SF", and a solution in which 0.29 g of ammonium persulfate were dissolved into 50 g of distilled water were respectively dripped over 3 hours by different dripping apparatuses. After dripping, stirring was further continued for 5 hours to obtain an emulsion of acrylic crosslinked fine resin particles having a dry solids ratio of 38.5% by weight, a mean volume particle diameter of 0.089 μm, 124.7 millimoles of carboxyl groups per 100 g of resin solid content, and a water soluble resin content of 0.3% by weight, relative to the total weight of acrylic crosslinked fine resin particles. Hereinafter, this emulsion is referred to as aqueous resin composition (B).

Synthesis Example 3

Synthesis Example of Aqueous Resin Composition (C)

In a 1 liter four-necked flask equipped with a stirrer, a condenser, a dry nitrogen introduction pipe with a thermometer, and a dripping apparatus were charged 228 g of distilled water, 0.22 g of methyl methacrylate, and 0.44 g of "NEWCOL-560SF"(trade name for emulsifier manufactured by Nippon Nyukazai Co., Ltd.) and were heated to 80° C. while stirring well. After 15 minutes of stirring, 0.44 g of methyl methacrylate were added into the four-necked flask and were mixed well. After 20 minutes of stirring, a solution in which 0.17 g of ammonium persulfate was dissolved into 5 g of distilled water was added into the four-necked flask and was then stirred well. After 20 minutes, a mixture including 170 g of methyl methacrylate and 1.26 g of "NEWCOL-560SF", and a solution in which 0.29 g of ammonium persulfate was dissolved into 50 g of distilled water were respectively dripped over 3 hours by different dripping apparatuses. After dripping, stirring was further continued for 5 hours to obtain an emulsion of acrylic fine resin particles, which have a dry solids ratio of 38.5% by weight, relative to the total weight of acrylic fine resin particles, and a mean volume particle diameter of 0.089 μm, and which does not include a carboxyl group and a water soluble resin. Hereinafter, this emulsion is referred to as aqueous resin composition (C).

Synthesis Example 4

Synthesis Example of Aqueous Resin Composition (D)

6 g of an ammonia solution, in which 25% by weight of ammonia was included, was added into 100 g of the aqueous resin composition (A) obtained in Example Synthesis 1, and this was stirred well to obtain an emulsion of acrylic resin fine particles having a dry solids ratio of 38.5% by weight, a mean volume particle diameter of 0.089 μm, 124.7 millimoles of carboxyl groups per 100 g of resin solid content, and a water soluble resin content of 7.7% by weight, relative to the total weight of acrylic resin fine particles. Hereinafter, this emulsion is referred to as aqueous resin composition (D).

Synthesis Example 5

Synthesis Example of Aqueous Resin Composition (E)

6 g of an ammonia solution, in which 25% by weight of ammonia was included, was added into 100 g of the aqueous resin composition (B) obtained in Example Synthesis 2 and stirred well to obtain an emulsion of acrylic crosslinked resin fine particles having a dry solids ratio of 38.5% by weight, a mean volume particle diameter of 0.089 μm, 124.7 millimoles of carboxyl groups per 100 g of resin solid content, and a water soluble resin content of 7.7% by weight, relative to the total weight of acrylic crosslinked fine resin particles. Hereinafter, this emulsion is referred to as aqueous resin composition (E).

Synthesis Example 6

Synthesis Example of Aqueous Resin Composition (F)

In a 1 liter four-necked flask equipped with a stirrer, a reflux condenser, a dry nitrogen introduction pipe provided with a thermometer, and a dripping apparatus were charged 100 g of methyl ethyl ketone, and the temperature was increased to 80° C. Then, 20 g of styrene, 36.19 g of methyl methacrylate, 11.55 g of acrylic acid, 32.26 g of butyl methacrylate, and 2 g of PERBUTYL-O (trade name for a polymerization initiator manufactured by Nippon Oil & Fats Co., Ltd.) were well mixed, and this was dripped over 3 hours. After dripping, stirring was further continued for 15 hours to terminate the polymerization reaction. Then, 10.9 g of an ammonia solution in which 25% by weight of ammonia was included was added into the resulting resin solution, and was stirred well. Subsequently, 400 g of distilled water was added to obtain an aqueous solution, heated to 30° C., and evaporated the organic solvent and excess water in a vacuum to obtain an acrylic water soluble resin, which had a dry solids ratio of 25% by weight, relative to the total weight of acrylic water soluble resin, 160 millimoles of carboxyl groups per 100 g of resin solid content, a weight average molecular weight of 4000, and Tg of 76° C. Hereinafter, this is referred to as acrylic water soluble resin.

Example 1

31.2 g of the aqueous dispersion of aqueous resin composition (D) obtained in the Synthesis Example 4, 3 g of "Carbon Black MA-100" (carbon black manufactured by Mitsubishi Chemical Corp.), 17 g of water and 15 g of isopropyl alcohol were mixed well. 180 g of 1.25 mm zirconia beads were added thereto and dispersed therein by a paint conditioner for 1 hour. Then, the zirconia beads were filtered and removed, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and was dried at 60° C. for 4 minutes, to thereby obtain a lithographic printing plate having a film thickness of 2 μm.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity 1/e$^2$ of the peak was 17 μm. After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried. The sensitivity thereof was 180 mJ/cm$^2$, and a non-image portion was peeled off clearly. After the lithographic printing plate was heated in the thermo-hygrostat at 60° C. and 75% humidity for 15 hours, no change was observed in the development property, and blurs in the non-image portion were also not observed. The results are shown in Tables 1 and 2.

Example 2

31.2 g of the aqueous dispersion of aqueous resin composition (E) obtained in the Synthesis Example 5, 3 g of "Carbon Black MA-100" (carbon black manufactured by Mitsubishi Chemical Corp.), 17 g of water and 15 g of isopropyl alcohol were mixed well. 180 g of 1.25 mm zirconia beads was added thereto and dispersed therein by a paint conditioner for 1 hour. Then, the zirconia beads were filtered and removed, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and this was then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and this was dried at 60° C. for 4 minutes to thereby obtain a lithographic printing plate having a film thickness of 2 $\mu$m.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity 1/e$^2$ of the peak was 17 $\mu$m. After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried. The sensitivity thereof was 200 mJ/cm$^2$, and a non-image portion was peeled off cleanly. After the lithographic printing plate was heated in the thermo-hygrostat at 60° C. and 75% humidity for 15 hours, no change was observed in the development property, and blurs in the non-image portion were also not observed. The results are shown in Tables 1 and 2.

Example 3

28.76 g of the aqueous dispersion of aqueous resin composition (E) obtained in the Synthesis Example 5, 3.7 g of acrylic water soluble resin obtained in the Synthesis Example 6, 3 g of "Carbon Black MA-100" (carbon black manufactured by Mitsubishi Chemical Corp.), 23.54 g of water and 16 g of isopropyl alcohol were mixed well. 180 g of 1.25 mm zirconia beads were added thereto and were dispersed therein by a paint conditioner for 1 hour. Then, the zirconia beads were filtered and removed, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and dried at 60° C. for 4 minutes, to thereby obtain a lithographic printing plate having a film thickness of 2 $\mu$m.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity 1/e$^2$ of the peak was 17 $\mu$m. After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried. The sensitivity thereof was 200 mJ/cm$^2$, and a non-image portion was peeled off cleanly. After the lithographic printing plate was heated in the thermo-hygrostat at 60° C. and 75% humidity for 15 hours, no change was seen in the development property, and blurs in the non-image portion were not also seen. The results are shown in Tables 1 and 2.

Example 4

13 g of the aqueous dispersion of aqueous resin composition (E) obtained in the Synthesis Example 5, 3.7 g of an infrared absorption agent represented by the below-described chemical formula, 9.92 g of water and 5.37 g of isopropyl alcohol were mixed well. 180 g of 1.25 mm zirconia beads were added thereto and were dispersed therein by a paint conditioner for 1 hour. Then, the zirconia beads were filtered and removed, to thereby obtain a coating solution of the photosensitive composition containing carbon black dispersed therein.

Chemical Formula 1

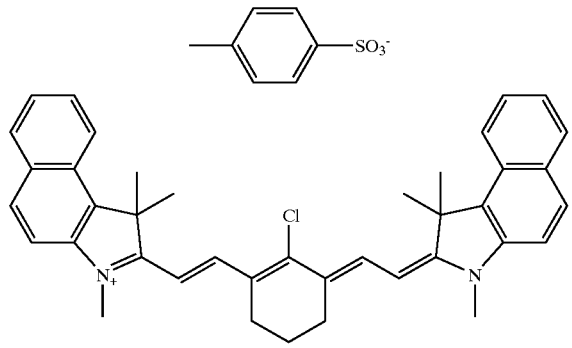

The surface of an aluminum plate larger than B4 size having a thickness of 0.3 mm was sand blasted by using a nylon brush and an aqueous suspension of 400 mesh pumice stone, and this was then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and this was dried at 60°

C. for 4 minutes, to thereby obtain a lithographic printing plate having a film thickness of 2 μm.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity $1/e^2$ of the peak was 17 μm. After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried. The sensitivity thereof was 170 mJ/cm$^2$, and a non-image portion was peeled off cleanly. After the lithographic printing plate was heated in the thermo-hygrostat at 60° C. and 75% humidity for 15 hours, no change was observed in the development property, and blurs in the non-image portion were also not observed. The results are shown in Tables 1 and 2.

Example 5

By using the lithographic printing plate obtained in Example 4, an image exposure was performed by means of a Trendsetter exposure machine 3244F mounted with a near infrared-ray semiconductor laser (manufactured by Creo Products Inc.). After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried to obtain a lithographic printing plate on which images from a computer are formed. After the lithographic printing plate was heated in the thermo-hygrostat at 60° C. and 75% humidity for 15 hours, no change was seen in the development property, and blurs in the non-image portion were not also seen. The results are shown in Tables 1 and 2.

Comparative Example 1

31.2 g of the aqueous dispersion of aqueous resin composition (A) obtained in the Synthesis Example 1, 3 g of "Carbon Black MA-100" (carbon black manufactured by Mitsubishi Chemical Corp.), 17 g of water and 15 g of isopropyl alcohol were mixed well. 180 g of 1.25 mm zirconia beads was added thereto and dispersed therein by a paint conditioner for 1 hour. However, the dispersion including the aqueous resin composition (A) and "carbon black MA-100" was solidified, and a coating solution of a photosenstitive composition containing carbon black stably dispersed therein could not be obtained. The results are shown in Tables 1 and 2.

Comparative Example 2

15.58 g of the aqueous dispersion of aqueous resin composition (E) obtained in the Synthesis Example 5, 24 g of acrylic water soluble resin obtained in the Synthesis Example 6, 3 g of "Carbon Black MA-100" (carbon black manufactured by Mitsubishi Chemical Corp.), 16.42 g of water and 15 g of isopropyl alcohol were mixed well. 180 g of 1.25 mm zirconia beads was added thereto and dispersed therein by a paint conditioner for 1 hour. Then, the zirconia beads were filtered and removed, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and this was dried at 60° C. for 4 minutes, to thereby obtain a lithographic printing plate having a film thickness of 2 μm.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity $1/e^2$ of the peak was 17 μm. After the image exposure, the plate was dipped, using a 1:99 diluted solution of a developer for positive PS plates "PD-1" (manufactured by Kodak Polychrome Graphics Japan Ltd.) at 30° C. for 30 seconds to effect development, and this was washed with water and dried. The sensitivity thereof was 170 mJ/cm$^2$, and a non-image portion was peeled off cleanly. After the lithographic printing plate was heated in the thermo-hygrostat at 60° C. and 75% humidity for 15 hours, no change was observed in the development property, and blurs in the non-image portion were also not observed. The results are shown in Tables 1 and 2.

Comparative Example 3

31.16 g of the aqueous dispersion of aqueous resin composition (B) obtained in the Synthesis Example 2, 12.84 g of water and 16 g of isopropyl alcohol were mixed well. 15 g of a carbon black dispersion containing 20% by weight of carbon black in water, and 5 g of a polyvinyl acetate solution containing 20% by weight of polyvinyl acetate having 98% by weight of hydrolysate thereof were subsequently added in this order into the resulting solution while stirring, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and this was then anodized in an electrolyte containing 20% sulfuric acid at a current density of 2 A/dm$^2$. After an oxide film of 2.7 g/m$^2$ was formed, the aluminum plate was washed with water and dried to thereby obtain a support.

The support was coated with the aforementioned coating solution by using a No. 5 bar coater, and this was dried at 60° C. for 4 minutes, to thereby obtain a lithographic printing plate having a film thickness of 2 μm.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity $1/e^2$ of the peak was 17 μm. After the image exposure, the plate was dipped, using a 1:99 diluted solution of a developer for positive PS plates "PD-1" (manufactured by Kodak Polychrome Graphics Japan Ltd.) at 30° C. for 30 seconds to achieve development. However, a non-image portion could not be peeled off cleanly. The results are shown in Tables 1 and 2.

Comparative Example 4

5.83 g of a carbon black dispersion containing 15% by weight of carbon black in water, 57.92 g of water, and 25 g of a polyvinyl acetate solution containing 2% by weight of polyvinyl acetate having 98% by weight of hydrolysate thereof are subsequently added into 2.92 g of the aqueous dispersion of aqueous resin composition (C) obtained in the Synthesis Example 3 and 8.33 g of water, while stirring, to thereby obtain a coating solution of the photosensitive composition containing carbon black dispersed therein.

The surface of an aluminum plate larger than B4 size having a thickness of 0.3 mm was sand blasted by using a nylon brush and an aqueous suspension of 400 mesh pumice stone, and then anodized in an electrolyte containing 20% sulfuric acid at a current density of 2 A/dm$^2$. After an oxide film of 2.7 g/m$^2$ was formed, the aluminum plate was washed with water and was dried to thereby obtain a support.

The support was coated with the aforementioned coating solution by using a No. 20 bar coater, and this was dried at 60° C. for 4 minutes, to thereby obtain a lithographic printing plate having a film thickness of 2 $\mu$m.

By using this lithographic printing plate, an image exposure was performed, while changing the exposure dose by means of a test exposure machine mounted with a near infrared-ray semiconductor laser (wavelength: 830 nm, maximum power: 1 W, manufactured by Line Denshi Co., Ltd.). The bore diameter of the laser at an intensity 1/e$^2$ of the peak was 17 $\mu$m. After the image exposure, the plate was dipped, using water at 30° C. for 60 seconds to effect development, and this was washed with water and dried. The sensitivity thereof was 1200 mJ/cm$^2$, and a non-image portion was peeled off cleanly. After the lithographic printing plate was heated in the thermo-hygrostat at 60° C. and 75% humidity for 15 hours, non-image areas colud not be eliminated. The results are shown in Tables 1 and 2.

Comparative Example 5

9.09 g of the aqueous dispersion of aqueous resin composition (C) obtained in the Synthesis Example 3, 7.5 g of a polyvinyl acetate solution containing 20% by weight of polyvinyl acetate having 98% by weight of hydrolysate thereof, 0.37 g of an infrared absorption agent, 4.55 g of water and 5.37 g of isopropyl alcohol were mixed well. 180 g of 1.25 mm zirconia beads were added thereto and were dispersed therein by a paint conditioner for 1 hour. However, the dispersion including the aqueous resin composition (C) and the infrared absorption agent was solidified, and a coating solution of a photosenstitive composition containing carbon black stably dispersed therein could not be obtained. The results are shown in Tables 1 and 2.

Printing Test

An image was inscribed on the lithographic printing plates obtained by Examples 1 to 5 and Comparative Examples 2 and 4 using energy amounts of appropriate to the sensitivity of respective lithographic printing plates, by using a test exposure machine (wavelength: 830 nm, maximum power: 1 W, manufactured by Line Denshi Co., Ltd.), and thereafter, respective plates were subjected to development processing, under the same conditions as in the Examples, were washed with water, and were dried to thereby obtain a printing plate.

The printing plates obtained in this manner and the printing plate obtained in Example 5 were mounted on a printing machine (TOKO 820L: Tokyo Kouku Keiki Co.), respectively, to perform printing tests. Under the conditions of printing speed: 3000 sheets/hour, printing paper: Jujyo Diacoat B4, ink: GEOS-G Beni S (manufactured by Dainippon-Ink and Chemicals, Inc.), dampening solution: NA108W (1:50 dilution, manufactured by Dainippon Ink and Chemicals, Inc.), as the printing conditions, 6,000 sheets were printed as a printing test. The results are shown in Table 2. 6,000 printed sheets obtained thereby did not have any quality problems, and were excellent.

TABLE 1

| | Fine Particles of Resin | | | | |
|---|---|---|---|---|---|
| | Anionic | | Water Soluble Resin | | |
| | Group (Millimole/ 100 g of resin) | Presence of Neutralized Groups | Content (wt %) | Presence of Anionic Group | Presence of Neutralized Groups |
| Example 1 | 124.7 | Yes | 7.7 | Yes | Yes |
| Example 2 | 124.7 | Yes | 7.7 | Yes | Yes |
| Example 3 | 124.7 | Yes | 7.7 | Yes | Yes |
| Example 4 | 124.7 | Yes | 7.7 | Yes | Yes |
| Example 5 | 124.7 | Yes | 7.7 | Yes | Yes |
| Comparative Example 1 | 124.7 | No | 0.3 | — | — |
| Comparative Example 2 | 124.7 | Yes | 53.8 | Yes | Yes |
| Comparative Example 3 | 124.7 | No | 7.7 | No | No |
| Comparative Example 4 | 0 | — | 36.7 | No | No |
| Comparative Example 5 | 0 | — | 30.0 | No | No |

TABLE 2

| | Sensitivity (mJ/cm$^2$) | Storage stability | Printing Test |
|---|---|---|---|
| Example 1 | 180 | Good | Good |
| Example 2 | 200 | Good | Good |
| Example 3 | 200 | Good | Good |
| Example 4 | 170 | Good | Good |
| Example 5 | — | Good | Good |
| Comparative Example 1 | Application Solution Solidified. | — | — |
| Comparative Example 2 | 170 | Development of Non-Image Area is not Good. | Good |
| Comparative Example 3 | Development of Non-Image Area is not Good. | — | — |
| Comparative Example 4 | 1200 | Development of Non-Image Area is not Good. | Not Good after Printing One Thousand Sheets |
| Comparative Example 5 | Application Solution Solidified. | — | — |

Since the photosenstitive composition includes the fine particles (a) and the water soluble resin (b) which have respectively at least one neutralized anionic group, the photosenstitive composition can be preferably used for producing the photosensitive layer of the original plate for lithographic printing, in which the images can be inscribed by irradiation of laser beam, the loss of images can be prevented, the resolving power and the sensitivity are high, and the development property of non-image area and the storage stability are improved.

When the aqueous resin composition is produced by adding the basic compound into the fine particles (a') having at least one anionic group and having a heat fusion property, the aqueous resin composition can be easily obtained, and the content of the water soluble resin (b) can be easily regulated by selecting the kind or the quantity of the basic compound used.

When the fine particles (a') of the resin having at least one anionic group and having a heat fusion property are produced by the emulsion polymerization, the anionic group or another functional group can be easily substituted into the fine particles of the resin, and the Tg can be easily controlled.

When the glass-transition temperature of the resin having the heat fusion property is in a range of 50 to 150° C., the storage stability is improved, and the fine particles (a) can be melted and fused with each other by irradiation of a small amount of energy.

When the resin forming the fine particles (a) or the fine particles (a') has 35 to 530 millimoles of anionic groups per 100 g of resin solid content, the development property of the non-image areas can be improved, and the fine particles (a) or the fine particles (a') can be easily produced.

When the fine particles (a) are crosslinked with each other, the printing resistance, the storage stability, and the sensitivity can be improved.

Since the original plate for lithographic printing is provided with the photosensitive layer using the photosenstitive composition on the hydrophilic surface of the support, the printing plate can be made after laser-inscription without preheating, and the sensitivity, the storage stability, and the printing resistance can be improved. Since the image-producing method includes the steps of: inscribing images by using laser beam on the original plate for lithographic printing, and developing the images by using a basic aqueous solution or water, printing plates, in which the loss of image and blurs in non-image portions can be prevented, and the resolution power of the image area and the printing resistance can be improved, can be easily produced. When the laser beam having the maximum strength in a range of 760 to 3000 nm is used in the image-producing method, the original plate for lithographic printing can be handled in a lighted room.

What is claimed is:

1. A photosenstitive composition comprising:

an aqueous resin composition including fine particles (a) of a resin having at least one neutralized anionic group and having a heat fusion property, and a water soluble resin (b) having at least one neutralized anionic group, wherein the water soluble resin (b) is included in a range of 1 to 30% by weight, relative to the total weight of the aqueous resin composition; and a substance (c) which absorbs light and generates thermal energy.

2. A photosenstitive composition according to claim 1, wherein the aqueous resin composition is produced by adding a basic compound to fine particles (a') of a resin having at least one anionic group and having a heat fusion property.

3. A photosenstitive composition according to claim 2, wherein the fine particles (a') of the resin having at least one anionic group and having a heat fusion property are produced by an emulsion polymerization.

4. A photosenstitive composition according to claim 1, wherein the glass-transition temperature of the resin having a heat fusion property is in a range of 50 to 150° C.

5. A photosenstitive composition according to claim 1, wherein the resin forming the fine particles (a) has 35 to 530 millimoles of anionic groups per 100 g of resin solid content.

6. A photosenstitive composition according to claim 2, wherein the resin forming the fine particles (a') has 35 to 530 millimoles of anionic groups per 100 g of resin solid content.

7. A photosenstitive composition according to claim 1, wherein the fine particles (a) are crosslinked with each other.

8. An original plate for lithographic printing comprising:

a support having a hydrophilic surface; and a photosensitive layer which includes a photosenstitive composition according to claim 1 and is disposed on the hydrophilic surface.

9. An image-producing method comprising the steps of:

inscribing images by using a laser beam on the original plate for lithographic printing according to claim 8; and developing the images by using a basic aqueous solution or water.

10. An image-producing method according to claim 9, wherein the laser beam has a maximum strength in a range of 760 to 3000 nm.

* * * * *